US012751516B2

(12) United States Patent
Rietdyk

(10) Patent No.: US 12,751,516 B2
(45) Date of Patent: Oct. 6, 2026

(54) BAYONET RECEIVER FOR HELMET

(71) Applicant: LIFT Airborne Technologies LLC, Rancho Dominguez, CA (US)

(72) Inventor: Guido Rietdyk, Rolling Hills, CA (US)

(73) Assignee: LIFT Airborne Technologies LLC, Rancho Dominguez, CA (US)

( * ) Notice: Subject to any disclaimer, the term of this patent is extended or adjusted under 35 U.S.C. 154(b) by 80 days.

(21) Appl. No.: 18/401,486

(22) Filed: Dec. 30, 2023

(65) Prior Publication Data

US 2025/0212986 A1 Jul. 3, 2025

(51) Int. Cl.
*A42B 3/28* (2006.01)
*A42B 3/04* (2006.01)

(52) U.S. Cl.
CPC ..... *A42B 3/288* (2013.01); *A42B 3/0433* (2013.01)

(58) Field of Classification Search
CPC ..... A42B 3/288; A42B 3/228; A63B 71/10; A62B 18/084
See application file for complete search history.

(56) References Cited

U.S. PATENT DOCUMENTS 3,035,573 A 5/1962 Morton
4,577,375 A * 3/1986 Beaussant ..... F16B 21/16 24/DIG. 45
4,689,836 A * 9/1987 Vitaloni ..... A42B 3/222 2/9
4,713,844 A 12/1987 Westgate
6,182,298 B1 * 2/2001 Dampney ..... A44B 11/25 292/10
6,474,337 B1 11/2002 Acker et al.
6,883,182 B2 4/2005 Necci et al.
7,181,776 B2 2/2007 Necci et al.
11,672,296 B2 6/2023 Rogers et al.
2002/0020004 A1 2/2002 Beautz
2016/0085077 A1 3/2016 Milea et al.
2022/0312883 A1 * 10/2022 Locatelli ..... A42B 3/30

FOREIGN PATENT DOCUMENTS

EP 3868236 A1 * 8/2021 ..... A42B 3/223
GB 2166189 A * 4/1986 ..... A44B 11/266

* cited by examiner

*Primary Examiner* — Katherine M Moran
(74) *Attorney, Agent, or Firm* — Lowe Graham Jones PLLC

(57) ABSTRACT

Embodiments are directed toward a helmet including a receiver for adjustably securing a mask. The mask includes a bayonet to be received by the receiver. The receiver includes a bayonet coupler and a plate pressed against the coupler. The coupler has a channel for releasably engaging the bayonet of the mask mount. The plate is fixedly secured to the helmet shell outboard of the coupler. The coupler is rotatably secured to the plate, the coupler having a pin extending outwardly therefrom through the plate and to the exterior of the helmet shell.

22 Claims, 4 Drawing Sheets

BAYONET RECEIVER FOR HELMET

FIELD OF THE INVENTION

The invention relates generally to oxygen mask mounting assemblies with aviation helmets and, more particularly, to mount and mask positioning.

BACKGROUND OF THE INVENTION

Aviation helmets have long been equipped with mounts to secure oxygen masks to the front thereof for use by pilots and others aboard high-elevation and performance aircraft. The standard mount uses a rigid member on each side of the helmet to secure flexible straps that extend to a mask to fit over the mouth and nose of the user. The rigid members include bayonets removably secured within a receiver assembly fixed to the right and left sides of the helmet just forward of and slightly below the ear-receiving portions of the helmet. The mount is fitted to a particular user of the helmet by drilling holes in the helmet shell and using fasteners to fix the angular position of the mounts for securing the oxygen mask at the optimum position for the user. Further fine tuning of the fit can be carried out with the mask straps, however, once the holes are drilled, the macro fixation is set. If the angular position is off, new holes have to be drilled, although they cannot be too close to the old holes or the shell must be scrapped. Fitting the helmet to a new user does not generally work unless they happen to have nearly the same dimensions for head and face shape. While this generally works, it can be a costly way of fitting, especially if adjustments are needed or the helmet is to be used by another person.

SUMMARY OF THE INVENTION

The present disclosure sets forth a receiver securable to a helmet, specifically to a helmet shell. The receiver adjustably secures a mask having a mask mount. The receiver includes a coupler and a plate that rotate relative to each other. The coupler releasably engages the mask mount. The plate is fixedly secured to the helmet. The coupler is rotatably secured to the plate to rotate relative to the helmet.

The plate is positioned outward of the coupler, speaking in terms of inward being toward the middle of the helmet and outward being opposite inward. Thus, the coupler is positioned on the inner side of the plate. The plate is fixed to the helmet shell. As noted, the coupler is rotatable relative to the plate and helmet as it is the portion that adjusts the angular position of the mask relative to the helmet.

The coupler includes first and second members that fasten together to create a channel to receive a bayonet from the mask mount assembly. At least one of the first member and the second member has ridges on the upper and lower portions thereof. Thus, with the ridges, when the first and second members are fastened together, the members form a channel between the ridges. The channel is oriented to receive the mask mount and includes guide ramps at the mouth thereof to direct the bayonet into the channel for in-and-out adjustment of the bayonet relative to the helmet.

The fixed plate includes numerous teeth extending in a full or partial circle. The teeth extend medially from the plate towards the coupler. The coupler also includes numerous teeth extending in a complementary direction facing the plate (i.e., laterally). These teeth also, at least partially, form a circle. The teeth of the plate engage the teeth of the coupler to hold an angular position of the coupler relative to the plate and, thus, relative to the helmet since the plate is fixed to the helmet. By changing the engagement position of the plate teeth to the coupler teeth, angular adjustments can be made to the position of the coupler relative to the plate.

To hold the opposing teeth together, a pin extends from the coupler through the plate. The pin is fixed to the lateral side of the coupler. The plate includes a hole therein for receiving the pin, the pin being long enough to extend through the helmet shell once the receiver is secured to the helmet. The pin is keyed to a washer that is on the outer side of the plate and exposed beyond the helmet shell. The washer includes an indicator mark to track the rotation of the coupler relative to the plate and helmet. The trim on the helmet includes markings adjacent to the indicator to note the angular adjustment of the receiver and, thus, of the face mask mounting. Preferably the pin is a bolt with a threaded nut fastened to the outer end thereof. Tightening the nut secures the angular position (rotational adjustment) of the coupler relative to the plate and helmet.

Thus, the present disclosure outlines a helmet with a receiver for adjustably securing an oxygen mask. The mask mount includes a bayonet. The coupler has a channel for releasably engaging the bayonet of the mask mount. A plate or other member is fixed to the helmet shell outboard of the coupler. The coupler is rotatably secured to the plate, the coupler having a pin extending outwardly therefrom through the plate and to the exterior of the helmet shell. Teeth on at least one of the plate and the coupler are positioned between the plate and the coupler. The helmet further includes a releasable securement member, such as a bolt and nut, to press the coupler against the plate to hold the coupler from rotation relative to the plate. An indicator rotates with the coupler to indicate the angular position of the coupler relative to the helmet.

BRIEF DESCRIPTION OF THE DRAWINGS

Preferred and alternative examples of the present invention are described in detail below with reference to the following drawings.

DETAILED DESCRIPTION OF THE PREFERRED EMBODIMENTS

The present disclosure sets forth an adjustable receiver assembly for the bayonet mount to secure an oxygen mask to an aviation helmet. The assembly provides an adjustment mechanism that is secure and immovable once in a desired angular location while still providing the option of changing the angular orientation to several different positions within a broad range over the face of the intended user to accommodate adjustments for a user or even adjustments to fit differing users without changing the mounting location of the receiver assembly.

Figure 1:
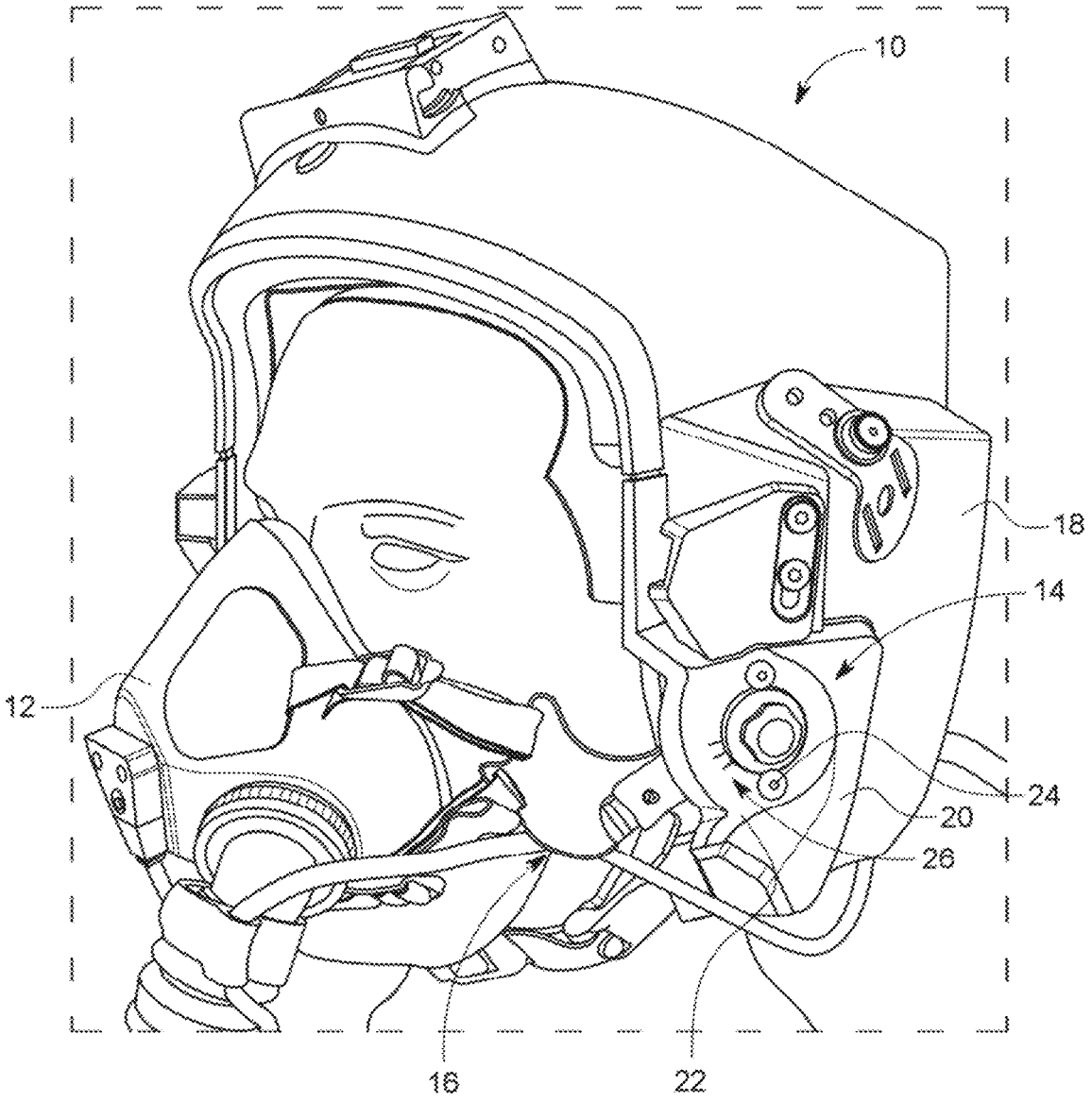
FIG. 1 is a perspective view of a helmet with an oxygen mask secured thereto.
Figure 2:
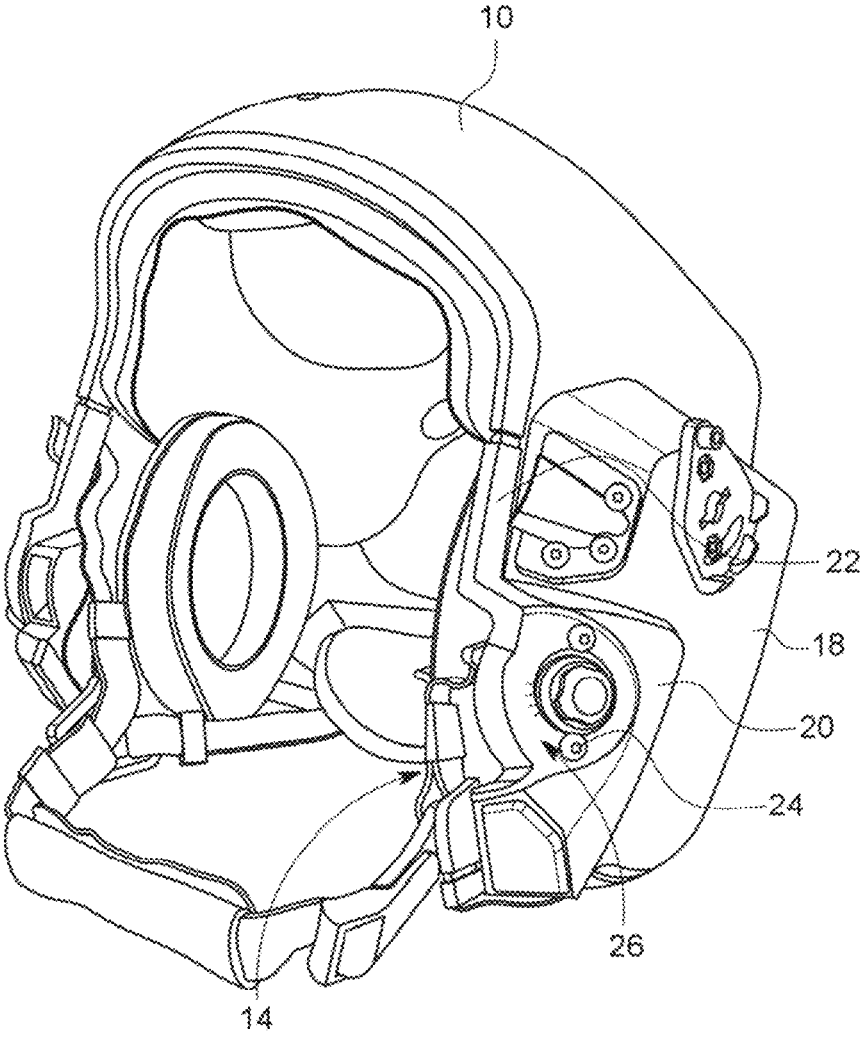
FIG. 2 is a perspective view of the helmet and receiver assembly.

Referring to FIGS. 1 and 2, a helmet 10 may be outfitted with an oxygen mask 12 at a forward, open side thereof. The helmet may be, in many or most respects, a standard aviation helmet or it may be a highly specialized helmet. The basic aspects of the present mask receiver apply across a range of helmets. In the preferred embodiment, the helmet includes a rigid shell such as a carbon fiber composite shell with a shape to accommodate the head of a user as well as communication devices, visual devices, protection aspects, etc. Thus, the helmet includes a receiver assembly 14 for securing a bayonet mount for the oxygen mask 12. The helmet includes right and left side portions 18 as well as right and left mount portions 20.

Side portions 18 bulge outwardly from the main helmet shell to house ear pads and audio communication devices between the shell and the ears of the user. The mount portions 20 bulge outwardly from the side portions 18 at a lower, forward region of the side portions 18. In the preferred embodiment, the mount portions are an integral portion of the helmet shell and are formed therewith. For example, with a carbon composite shell the side portions 18 and mount portions 20 are molded as one.

The receiver assembly 14 for the bayonet mount 16 is fixed to and extends inboard of the mount portions 20. As seen in FIGS. 1 and 2, the receiver assembly 14 includes a trim 22, outer fasteners 24, and indicator markings 26. The trim 22 may, in some cases, include portions of trim around the face opening of the helmet 10. The trim 22 preferably extends in a circular shape with outer fasteners 24 at upper and lower locations approximately 180 degrees apart. The indicator markings 26 are situated on a forward portion of the trim 22 between the fasteners. Again, the specifics can be changed as desired. For example, the indicator markings 26 can be on any portion of the receiver assembly 14 or even on the helmet shell, trim 22, or other portion that remains relatively fixed with regard to the main helmet portion that is stable relative to the head of the user, as long as the indicator markings 26 are readable by the person adjusting the position of the receiver assembly 14 relative to the helmet shell. As is evident in FIGS. 1 and 2, multiple positions of angular position adjustment are shown by the indicator markings 26.

Figure 3:
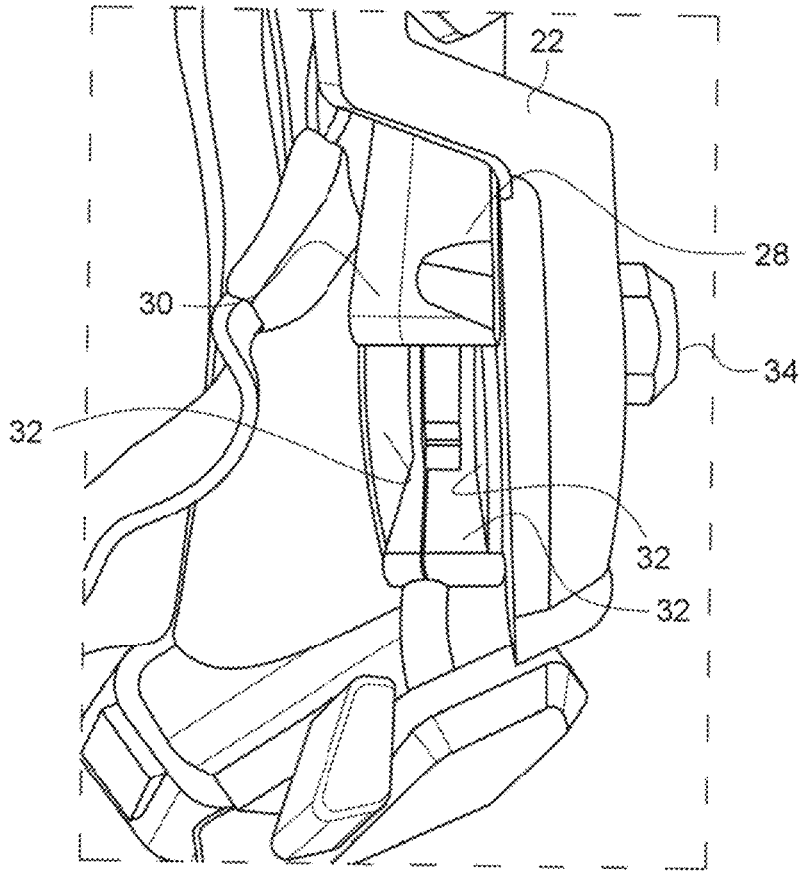
FIG. 3 is a front elevational view of the receiver assembly.

FIG. 3 provides more details regarding the construction and operation of the receiver assembly 14. The main receiver portion includes an outer receiver member 28 mated to an inner receiver member 30. The two members are fixed together to create an open channel 36 (see FIG. 4A as well) to receive the bayonet mount (shown in FIGS. 1, 5, and 6). The sides of outer and inner receiver members 28 and 30 that face each other form the channel 36 and the guide ramps 32 that surround the forward portion of the opening to the channel 36. Guide ramps 32 help direct the rearward insertion end of the bayonet mount 16 into the channel 36 of the receiver assembly 14 such that it may be inserted easily while the helmet is being worn by the user. FIG. 3 also shows nut 34 that is used to loosen the assembly for adjustment as will be detailed further below.

Figure 4A:
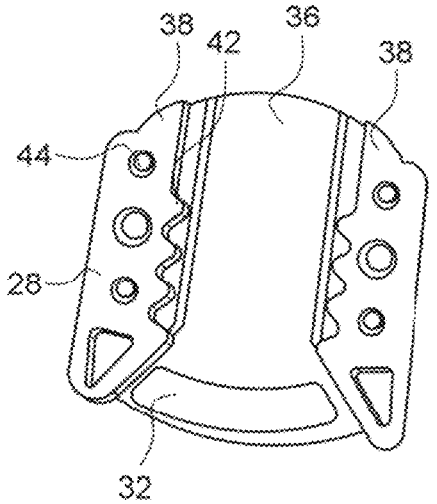
FIGS. 4A and 4B are side views of the receiver parts.
Figure 4B:
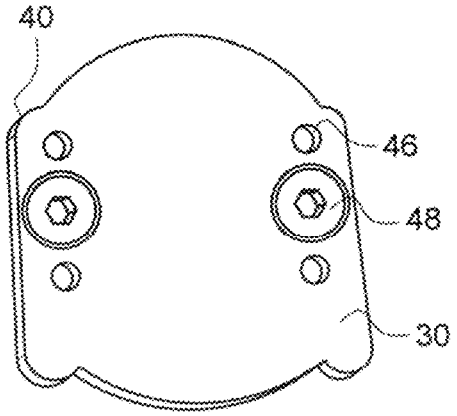

FIGS. 4A and 4B provide more details of the preferred construction of the outer and inner receiver members 28 and 30, respectively. FIG. 4A shows the side of outer receiver member 28 that faces the side of inner receiver member 30. The channel 36 is provided in part by outer receiver member 28 and, in lesser part, by inner receiver member 30. Of course, this arrangement may be switched or the two parts may be formed together or other configurations may be used. The channel is formed between upper and lower outer guide ridges 38 and inner guide ridges 40. The outer guide ridges 38 are part of outer receiver member 28, while the inner guide ridges are part of inner receiver member 30. The outer guide ridges 38 are thicker than the inner guide ridges in the preferred embodiment as they include teeth 42 for engagement with bayonet mount 16. Locator pins 44, locater holes 46, and fasteners 48 are used to register and secure outer and inner receiver members 28, 30 together in somewhat of a clamshell fashion.

Figure 5:
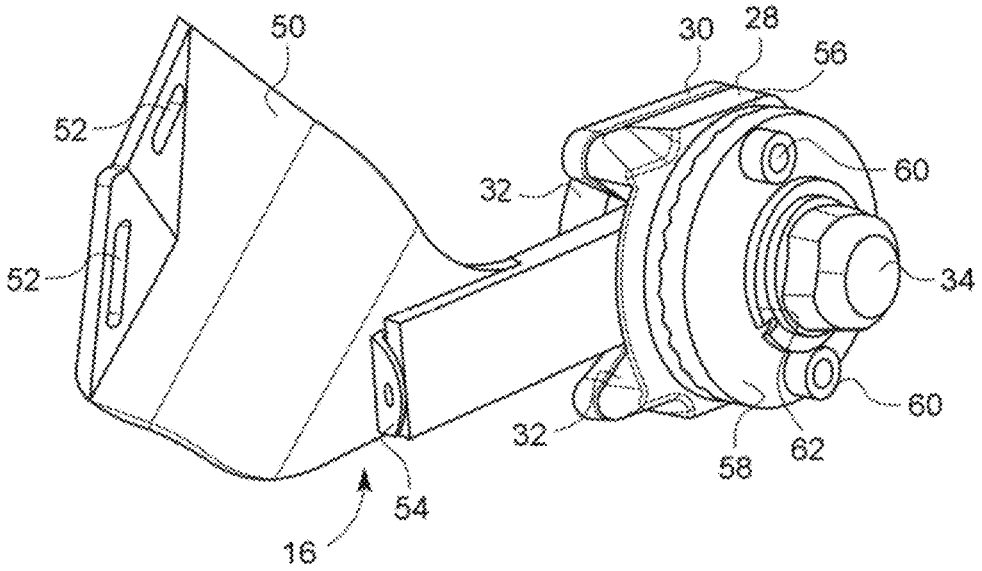
FIG. 5 is an isometric assembly view of the receiver and mount apart from the helmet and mask.

FIG. 5 shows the receiver assembly 14 removed from the helmet 10 with the bayonet mount 16 secured thereto. Bayonet mount 16 includes a mask mount 50 that extends forwardly and inwardly from the bayonet portion received into the receiver assembly 14. The shape and surfaces of mask mount 50 are dictated by the oxygen mask straps and the need to have a stable, secure mount for the mask. Mount slots 52 are provided for secure interface with the straps from oxygen mask 12. Here again the placement and size of the slots 52 are selected to accommodate the oxygen mask 12.

Each bayonet includes a release slide 54 either standard (those commonly available) or otherwise developed for use to release the bayonet from the receiver assembly 14. The bayonet is received within bayonet receiver 14, specifically between outer and inner receiver members 28, 30. These outer and inner receiver members form a coupler to receive and secure the bayonet. Such couplers are disposed on both the right and left sides of the helmet inside the right and left mount portions of the shell. As shown in FIG. 5, the outer receiver member 28 includes an inner adjustment plate 56. A mating outer adjustment plate 58 is fixed to the shell of helmet 10 by securement with fasteners 24 to bosses 60 that project from outer adjustment plate 58. Both right and left outer plates are provided. Nut 34 secures outer plate 58 to inner plate 56. Inner plate 56 is preferably an integral part of the outer face of outer receiver member 28. An indicator washer 62 is nested between nut 34 and outer plate 58, as will be better appreciated with regard to FIG. 6 and the description below. Bosses 60 preferably extend at least partially through the shell of helmet 10 whereas the helmet shell and or the trim 22 substantially or fully covers the outer face of outer plate 58 when receiver assembly 14 is secured to mount portion 20 of helmet 10, as illustrated in FIGS. 1 and 2.

Figure 6:
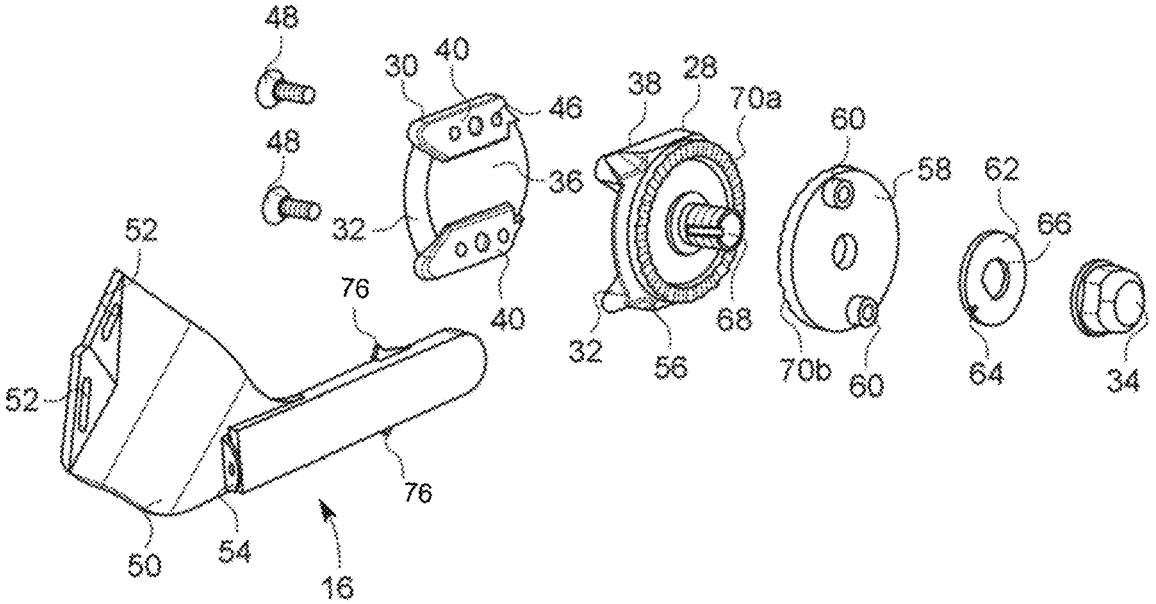
FIG. 6 is an exploded isometric view of the receiver and mount.

The exploded view of FIG. 6 shows further details of receiver assembly 14 and bayonet mount 16. Washer 62 includes a marker 64—basically just a line on an edge of the washer—for moving with inner adjustment plate 56 to show the relative position of inner plate 56 to outer plate 58. The position is preferably shown by referring to the indicator markings 26 on trim 22, as seen in FIGS. 1 and 2. Washer 62 includes a keyed hole 66 that non-rotatably engages with keyed bolt 68 that fixedly extends from outer receiver member 28, specifically from the center of inner adjustment plate 56.

Inner plate 56 includes a circular arrangement of rotational adjustment teeth 70*a* that mate with facing rotational adjustment teeth 70*b* projecting from outer plate 58. With so many mating teeth (70*a*, 70*b*) provided, small adjustments to the position of the inner plate 56 relative to outer plate 58 are possible. The mating teeth securely hold the position of the inner and outer plates relative to each other once nut 34 is tightened on keyed bolt 68. Thus, nut 34 combined with bolt 68 provides a tightening member to pull the coupler towards the plate to hold the angular position of the coupler relative to the plate. However, the assembly may be adjusted in its angular position relative to the helmet by loosening nut 34. Thus, the coupler adjustment mechanism is accessible from outside of the helmet shell creating an angular adjustment system. Rotation of the inner plate also rotates indicator washer 62 such that marker 64 shows the position relative to indicator markings 26 on trim 22. Thus, an indicator member (i.e., marker 64) is provided that is position-fixed relative to the couplers to move with the couplers while indicator markings are position-fixed relative to the helmet shell adjacent to the marker 64, which functions as the indicator member.

Finally in FIG. 6 the bayonet pawls 76 are shown on bayonet mount 16. Such pawls are preferably those on standard bayonet mounts.

Thus, the receiver assembly shown and described provides the advantage of allowing a user to non-destructively adjust the position of the face mask mounting while providing a secure, stable mount once the optimum position is achieved. Such is accomplished without undue complication or mass such that the assembly is robust, reliable, and easy to use.

I claim:

1. A helmet comprising a shell, a mask, and a receiver assembly secured to the shell, the receiver assembly being pivotally adjustable relative to the shell, the receiver assembly being secured to the mask, the mask having a mask mount secured to the receiver assembly, the receiver assembly comprising:

a coupler having a releasable engagement with the mask mount, the coupler being pivotally secured inside the helmet shell; and a plate fixedly secured to the helmet, the plate positioned inside the helmet shell between the coupler and the shell;

wherein the coupler is rotatably secured to the plate, the securement allowing adjustments to the position of the coupler relative to the plate, such adjustments accommodating position adjustments to properly align to different user faces; and wherein the position to which the mask is secured over the face may be held secure during use of the helmet and mask, the securement locking the rotational adjustment of the coupler to the plate.

2. The receiver assembly of claim 1, wherein the plate is an outer plate relative to the coupler, the coupler being positioned on the inner side of the plate and being rotatable relative to the plate and helmet.

3. The receiver assembly of claim 2, wherein the coupler is adjustable to multiple face-covering angular positions with the mask covering the face of the user and holding secure an angular position of the coupler relative to the plate such that the angular position is held secure for fit to a particular user, adjustment of the coupler being accessible from the outside of the helmet shell.

4. The receiver assembly of claim 2, further comprising an adjustment angle indicator showing the position of the coupler relative to the shell.

5. The receiver assembly of claim 4, wherein the helmet includes a trim on the helmet shell, the trim including markings positioned adjacent the adjustment angle indicator.

6. The receiver assembly of claim 2, further comprising a bolt extending from the coupler through the plate, the plate having a hole therein rotatably receiving the bolt, the bolt extending through the plate and through the helmet shell.

7. The receiver assembly of claim 6, wherein the bolt is keyed, the receiver assembly further including a washer keyed to the bolt and having an indicator marker to track the rotation of the coupler relative to the plate and helmet.

8. The receiver assembly of claim 7, wherein the bolt is a threaded bolt, the receiver assembly further including a threaded nut rotatably secured to the threaded bolt for locking the rotational adjustment of the coupler to the plate.

9. The receiver assembly of claim 2, further comprising a nut accessible laterally outside of the helmet main shell to pull the coupler towards the plate to hold an angular position of the coupler relative to the plate such that the angular position is secure and immovable.

10. The receiver assembly of claim 2, wherein the plate is fixed to the helmet shell.

11. The receiver assembly of claim 10, wherein the plate includes at least two bosses that extend outwardly from an outer face of the plate, the bosses adapted to extend through openings in the shell and having inner openings for receiving fasteners for fixed securement to the helmet shell.

12. The receiver assembly of claim 1, wherein the coupler includes a channel for receiving a bayonet member of the mask mount, the channel having a forward opening receiving end including guide ramps for directing the insertion of the bayonet member.

13. A helmet including a receiver assembly for adjustably securing a mask having a mask mount including bayonets, the helmet comprising:

a shell comprising:

a main helmet shell;

right and left side portions that bulge outwardly relative to the main helmet shell;

right and left mount portions that bulge outwardly relative to the respective right and left side portions; and receivers comprising:

right and left couplers positioned inside the right and left mount portions of the main helmet shell, the couplers having channels for releasably engaging the bayonets of the mask mount; and right and left plates fixedly secured to the main helmet shell outboard of the respective right and left couplers;

wherein the couplers are rotatably secured to the respective plates.

14. The helmet of claim 13, further comprising bosses fixed to and extending outwardly from the right and left couplers, the bosses extending from the plates, through the main helmet shell to an exterior of the main helmet shell.

15. The helmet of claim 13, further comprising threaded bolts extending outwardly from the right and left couplers and through the respective right and left plates and through the main helmet shell, the helmet further comprising nuts threaded to the bolts to secure the plates against the couplers.

16. The helmet of claim 13, further comprising releasable securement members to press the couplers against the plates to hold the couplers from rotation relative to the plates.

17. The helmet of claim 13, further comprising a washer secured to at least one of the threaded bolts to rotate therewith, the washer having an indicator mark thereon to show the position of the associated coupler relative to the main helmet shell.

18. The helmet of claim 13, further comprising an angular adjustment system accessible on the outside of the helmet for adjusting an angular position of the couplers relative to the main helmet shell.

19. The helmet of claim 18, further comprising an indicator position-fixed relative to the couplers to move with couplers and indicator markings position-fixed relative to the helmet shell adjacent to the indicator.

20. The helmet of claim 19, wherein the indicator and indicator markings are on an outside of the helmet shell.

21. The helmet of claim 20, further including a trim on at least a portion of at least one of said right and left mount portions, the trim including the indicator markings.

22. The helmet of claim 13, wherein the left and right plates include mounting bosses extending outwardly therefrom for engagement with the right and left mount portions of the main helmet shell.

* * * * *